US005276412A

United States Patent [19]

Yoneda et al.

[11] Patent Number: 5,276,412

[45] Date of Patent: Jan. 4, 1994

[54] HIGH-FREQUENCY FILTER HAVING INCREASED MECHANICAL STRENGTH

[75] Inventors: Takehiko Yoneda; Kazuhiro Eguchi; Hiromitsu Taki, all of Miyazaki, Japan

[73] Assignee: Matsushita Electric Industrial Co., Ltd., Osaka, Japan

[21] Appl. No.: 890,424

[22] Filed: May 29, 1992

[30] Foreign Application Priority Data

May 30, 1991 [JP] Japan ..... 3-127464

[51] Int. Cl.[5] ..... H01P 1/201

[52] U.S. Cl. ..... 333/202; 333/219.1; 333/238; 501/103

[58] Field of Search ..... 333/202, 204, 206, 219, 333/219.1, 222, 238; 501/103, 104, 105

[56] References Cited

U.S. PATENT DOCUMENTS

| | | | |
|---|---|---|---|
| 4,900,701 | 2/1990 | Morishita et al. | 501/105 X |
| 5,068,072 | 11/1991 | Horinouchi et al. | 501/103 X |
| 5,082,809 | 1/1992 | Hayashi | 501/103 X |
| 5,122,487 | 6/1992 | Hayakawa et al. | 501/103 |
| 5,180,696 | 1/1993 | Inoue | 501/103 X |

OTHER PUBLICATIONS

Stevens, *An Introduction to Zirconia,* Magnesium Elektron Publication, No. 113, Magnesium Elektron Ltd., Jun. 1983.

*Primary Examiner*—Paul Gensler

*Attorney, Agent, or Firm*—Lowe, Price, LeBlanc & Becker

[57] ABSTRACT

A high-frequency filter of the type having a plurality of resonators open at least at one end thereof, a dielectric board forming an input/output coupling and an interstage coupling, and a case for holding therein the resonators and the dielectric board, wherein the dielectric board is made of a ceramic having a critical stress intensity factor $K_{1c}$ of not less than 5 MPa·m$^{1/2}$ and a dielectric dissipation factor tan. δ of not exceeding 1% in a working frequency band of said high-frequency filter, and wherein electrodes are provided on the dielectric board to form an input/output coupling capacity and an interstage coupling capacity. The high-frequency filter of the foregoing construction has the advantage of an excellent mechanical strength which is capable of withstanding severe mechanical loads such as falling impacts or various stresses.

20 Claims, 4 Drawing Sheets

HIGH-FREQUENCY FILTER HAVING INCREASED MECHANICAL STRENGTH

BACKGROUND OF THE INVENTION

1. Field of the Invention

The present invention relates to a high-frequency filter for use in radio communication equipment, measuring equipment or the like, and more particularly to a high-frequency filter having an excellent mechanical strength.

2. Description of the Prior Art

In recent years, high-frequency filters have been used widely in the field of radio communication equipment, such as car telephones, portable telephones or personal radio communications. Conventional high-frequency filters include a dielectric board which is, in general, made of alumina or polytetrafluoroethylene (PTFE) fiber reinforced glass, as disclosed in Japanese Laid-open Patent Publication No. 60-114001 entitled "Coaxial Dielectric Filter".

However, the disclosed high-frequency filter has a drawback that as shown in FIGS. 8A and 8B of the accompanying drawings, the dielectric board 1 is likely to cause a break of coupled circuits due to a damage at the junction between the dielectric board 1 and input-/output pins 2 or between the dielectric board 1 and central conductors 3.

In particular, when the dielectric board 1 is made of a dielectric ceramic such as calcined alumina or barium titanate, it becomes likely that due to a pressure or force applied via the input/output pins 2, microcracks produced in the vicinity of the input/output pins 2 or holes 4 receiving therein the central conductors 3 are enlarged and eventually bring about fracture of the dielectric board 1. This is because the ceramic constituting the dielectric board 1 is a brittle material which is capable of absorbing only a little energy before its fracture. As against the brittleness, the toughness is represented in terms of the critical stress intensity factor (or fracture toughness) $K_{1c}$. The $K_{1c}$ of ceramic is in the range of 2–4 MPa·m$^{\frac{1}{2}}$. The brittleness of the ceramic is remarkable because even cast iron which is the most brittle material among ferrous metals has a $K_{1c}$ value of about 20 Mpa·m$^{\frac{1}{2}}$. In FIGS. 8A and 8B, numeral 5 designates resonators and 6 is a case for holding therein the resonators 5 and the dielectric board 1.

In the case where the dielectric board 1 is a plastic board made, for example, of polytetrafluoroethylene (PTFE) fiber reinforced glass, the foregoing problem of board fracture does not arise due to a high resiliency of the plastic board. However, the plastic board has a drawback that the moisture resistance (tan. δ, in particular) and heat resistance are poor as compared to those of the ceramic board.

SUMMARY OF THE INVENTION

With the foregoing drawbacks of the prior art in view, it is an object of the present invention to provide a high-frequency filter having an excellent mechanical strength which is capable of withstanding severe mechanical loads, such as falling impacts, various stresses, etc.

A high-frequency filter of this invention includes a plurality of resonators open at least at one end thereof, a plurality of input/output terminals, and a dielectric board supporting thereon the resonators and the input-/output terminals and forming an input/output coupling and an interstage coupling. The dielectric board is made of a ceramic having a critical stress intensity factor $K_{1c}$ of not less than 5 MPa·m$^{\frac{1}{2}}$ and a dielectric dissipation factor tan. δ of not exceeding 1% in a working frequency band of said high-frequency filter.

Preferably, the ceramic contains, as the principal ingredient, partial stabilized zirconia or tetragonal zirconia.

It is preferable that the ceramic comprises 85 to 98 mol percent of $ZrO_2$, and 15 to 2 mol percent of at least one component selected from the group consisting of $CeO_2$, CaO, MgO and $Y_2O_3$.

According to a preferred embodiment, the ceramic includes up to 0.5 part by weight, per 100 parts by weight of partial stabilized zirconia or tetragonal zirconia, of at least one component selected from the group consisting of $Al_2O_3$ and $SiO_2$. According to another preferred embodiment, the ceramic includes up to 1 part by weight, per 100 parts by weight of partial stabilized zirconia or tetragonal zirconia, of at least one component selected from the group consisting of $TiO_2$, CoO, MnO and NiO.

The high-frequency filter may be of the type which includes a dielectric board of the properties as specified above, a plurality of electrodes made preferably of Ag and formed on the dielectric board, a plurality of resonators of the coaxial type connected respectively to the electrodes, a plurality of input/output terminals attached to the dielectric board, and a case attached to the dielectric board for closing the resonators.

The above and other objects, features and advantages of the present invention will become more apparent from the following description when making reference to the detailed description and the accompanying sheets of drawings in which a preferred structural embodiment incorporating the principles of the present invention is shown by way of illustrative example.

DETAILED DESCRIPTION OF THE INVENTION

Figure 1:
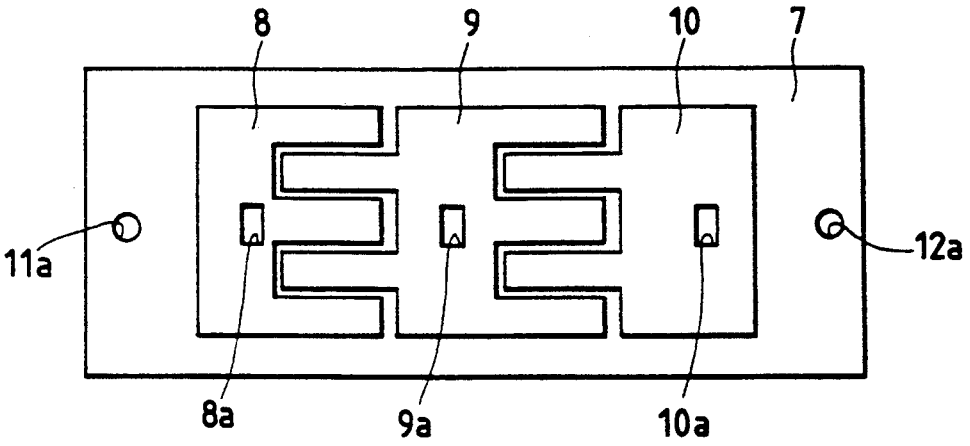
FIG. 1 is a plan view of a dielectric of a high-frequency filter according to the present invention.

A high-frequency filter according to an embodiment of this invention will be described below in greater detail. The high-frequency filter is produced according to the following processing steps.

1. Formulating, mixing and molding of raw materials for the dielectric board containing, as the principal ingredients, partial stabilized zirconia (zirconium oxide) or tetragonal zirconia.

Industrial materials with 99.9% purity, consisting of $ZrO_2$, $CeO_2$, $CaCO_3$, $MgCO_3$, $Y_2O_3$, $Al_2O_3$, $SiO_2$, $TiO_2$, CoO, $MnCO_3$ and NiO are used as raw materials. These materials are formulated according to the formulation shown in Table 1. Although oxides and carbonates are used in this embodiment, any other materials such as oxalates can be used so long as they decompose into oxides in a calcinating process. In addition, those additives other than $ZrO_2$ may be previously added to a compound by means of a tentative calcination. The formulated raw materials may be of the composition indicated by the following formula:

$Me(COOH)_x$, $Me(CO_3)_x$, $MeCl_x$, or $C_mH_nO_lMe_x$ where Me is one selected from Zr, Ca, Mg, Y, Ce, Al, Si, Ti, Co, Mn and Ni, and x, m, n and l are positive numbers.

100 parts by weight of formulated raw materials and 50 parts by weight of water are mixed homogeneously and ground for 1 hour by a stirring mill. To a slurry thus obtained are added 3 to 7 parts by weight of polyvinyl alcohol as an organic binder, 1 to 3 parts by weight of glycerin as a humectant, and 0.3 to 0.8 part by weight of dioctyl alcohol as an anti-foaming agent. From the resultant mixture, a granulated power with a grain size of 100 to 150 μm is formed using a spray dryer (manufactured by Hosokawa Micro K.K.). Using the granulated power, a dielectric board of 5 mm in width, 20 mm in length and 1 mm in thickness is molded by the dry molding.

There are also prepared raw materials other than zirconia, which materials include alumina consisting of 60% $Al_2O_3$, and magnesium titanate-calcium consisting of MgO-CaO-$TiO_2$.

2. Calcinating the molded dielectric boards

The dielectric boards molded as described above are calcined at 1400° to 500° C. for 1.5 to 3.0 hours. However, so far as 96%$Al_2O_3$ dielectric board is concerned, the calcination is performed at 1400° C. for 2 hours in an atmosphere of Ar gas using a hot isostatic press (HIP). Thus, dielectric boards 7 are formed.

3. Printing of electrodes

Figure 2:
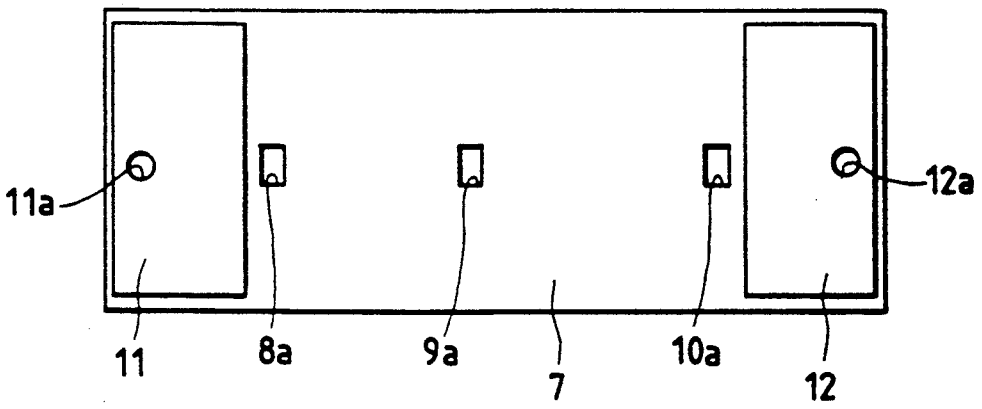
FIG. 2 is a bottom view of the dielectric board.

To each of the dielectric boards 7, Ag containing 10% of Pd is coated. The coating is baked at 850° C. for 10 min., thus forming electrodes printed on the dielectric board 7. The electrodes thus provided include, as shown in FIGS. 1 and 2, three electrodes 8, 9 and 10 formed on one surface of the dielectric board 7 in staggered relation so as to form interstage capacities, and two electrodes 11 and 13 formed on the opposite surface of the dielectric board 7. The electrodes 8, 9, 10, 11 and 12 have through-holes 8*a*, 9*a*, 10*a*, 11*a* and 12*a*, respectively.

Figure 3:
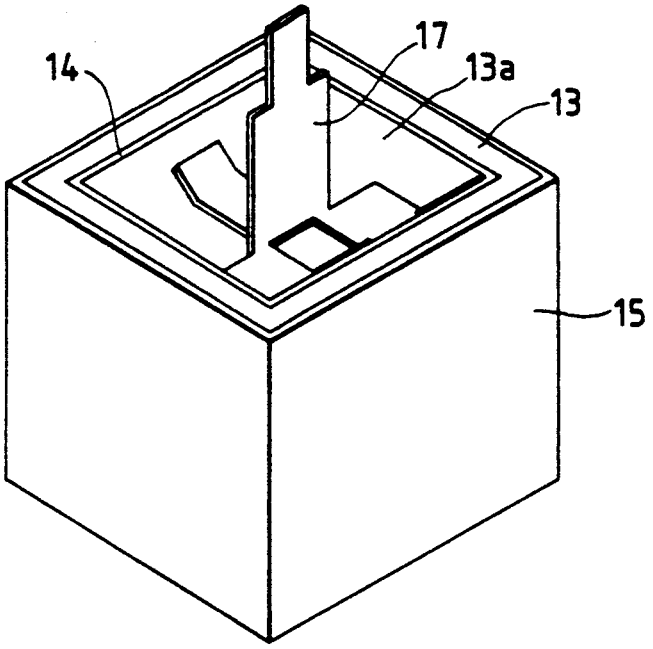
FIG. 3 is a perspective view of a dielectric resonator used in the high-frequency filter.
Figure 4:
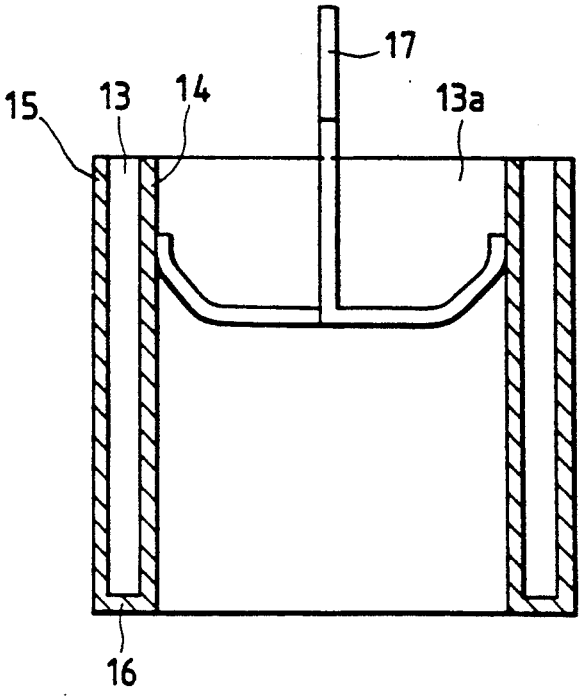
FIG. 4 is a cross-sectional view of the dielectric resonator.
Figure 5:
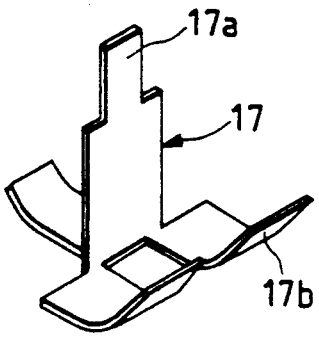
FIG. 5 is a perspective view of a terminal of the dielectric resonator.
Figure 6:
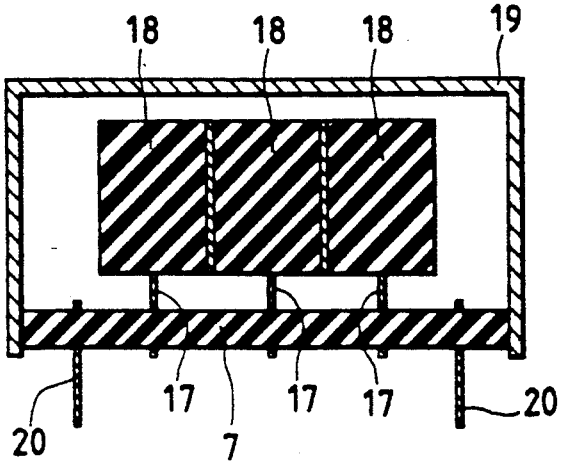
FIG. 6 is a cross-sectional view showing the general construction of the high-frequency filter of this invention.

4. Attaching resonators of a coaxial dielectric, and input/output terminals to the dielectric board An example of dielectric resonators is shown in FIGS. 3 and 4. The resonator includes a rectangular hollow body 13 made of a Ba-Ti-Sm-Nd-Bi-0 dielectric ($\epsilon r=95$) having a central through-hole 13*a*, an inside conductor 14 disposed on an inside surface of the hollow body 13, an outside conductor 15 disposed on an outside surface of the hollow body 13, and a short-circuiting conductor 16 interconnecting the inside and outside conductors 14 and 15. These conductors 14, 15 and 16 are formed by plating with copper on the hollow body 13, which copper plating is followed by plating with solder. A terminal 17 made of phosphor bronze, for example, is disposed in the through-hole 13*a*. As shown in FIG. 5, the terminal 17 includes an external connecting portion 17*a* extending parallel to a longitudinal axis of the hollow body 13, and a generally Y-shaped terminal attaching portion 17*b* extending substantially perpendicularly to the external connecting portion 17*a*. The terminal attaching portion 17*b* is firmly connected with the inside conductor 14 by means of a solder or a conductive adhesive (not shown). The dielectric resonator used in the illustrated embodiment has a hollow body of 6 mm square. Three dielectric resonators 18 of the foregoing construction are attached to the dielectric board 7, as shown in FIG. 6. In this instance, the external connecting portions 17*a* (FIG. 5) of the respective dielectric resonators 18 are inserted from the side shown in FIG. 2 into corresponding ones of the through-holes 8*a*, 9*a* and 10*a* and, subsequently, they are electrically connected by soldering to the electrodes 8, 9 and 10, respectively. Then, two input-output terminals 20 and 20 are inserted from the side shown in FIG. 1 into the through-holes 11*a* and 12*a* and, subsequently, they are electrically connected by soldering with the electrodes 11 and 12, respectively. In the illustrated embodiment, three dielectric resonators 18 which are open at opposite ends are assembled with the dielectric board 7. The number of the dielectric resonators 18 is illustrative rather than restrictive and, therefore, either a single or plural dielectric resonators can be used.

5. Mounting the dielectric resonator-and-board assembly in a case

As shown in FIG. 6, a case 19 is attached to the dielectric board 7 so as to cover the dielectric resonators 18. The case 19 is made of a copper alloy, such as phosphor bronze which is plated with Ni, and subsequently plated with solder. Thus, a high-frequency filter is produced.

Using the thus-obtained high-frequency filter, a strength measurement was made by way of a falling impact test in which, for each of the high-frequency filters according to inventive examples and comparative examples, 100 samples were dropped ten times from the level of 1 m onto a rigid wood and then these samples were checked for the occurrence of fracture of the dielectric board 7. The results thus obtained are shown in FIG. 7 in conjunction with the critical stress intensity factor $K_{1c}$ of the dielectric board.

Figure 7:
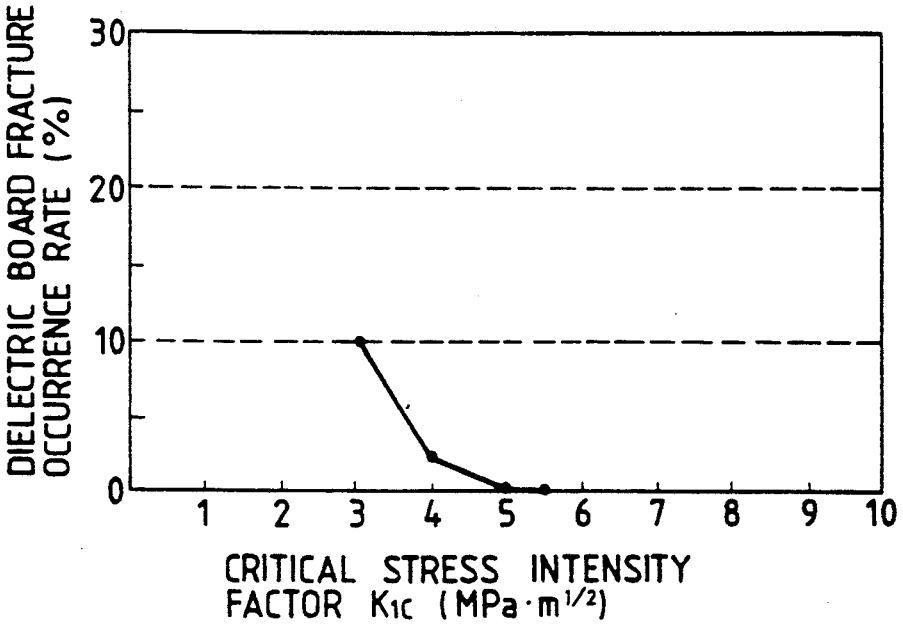
FIG. 7 is a graph showing the relation between the critical stress intensity factor and the board fracture occurrence rate.
Figure 8A:
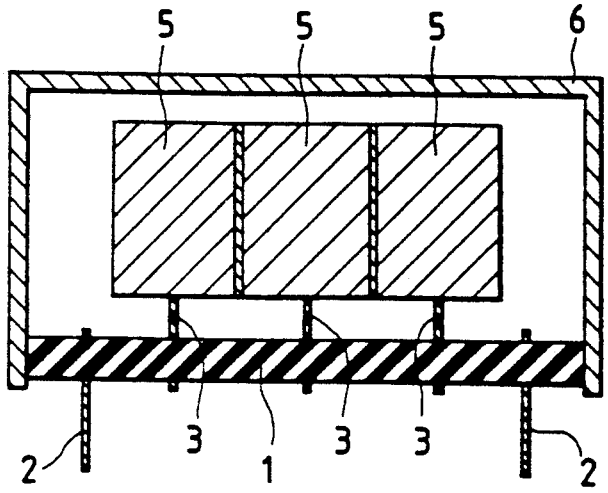
FIG. 8A PRIOR ART
FIG. 8A is a cross-sectional view showing a conventional high-frequency filter.
Figure 8B:
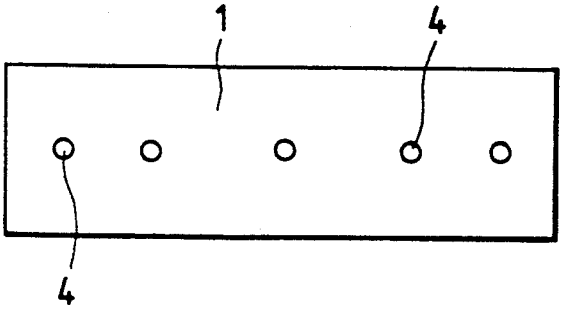
FIG. 8B PRIOR ART
FIG. 8B is a plan view of a dielectric board used in the conventional high-frequency filter.

As appears clear from FIG. 7, the dielectric board fracture occurrence rate is 0 (zero) when the critical stress intensity factor $K_{1c}$ is not less than 5 MPa·m$^{1/2}$. In the falling impact test, a magnesium titanate-calcium dielectric board was used as a sample dielectric substrate of $K_{1c}=3$ MPa·m$^{1/2}$. Similarly, a 96% $Al_2O_3$ board was used as a sample dielectric substrate of $K_{1c}=4$ MPa·m$^{1/2}$, and a 96% $Al_2O_3$ board treated on a hot isostatic press was used as a sample dielectric substrate of $K_{1c}=5.5$ MPa·m$^{1/2}$. For those sample dielectric substrates with a $K_{1c}$ value other than specified above, a partial stabilized zirconia board was used.

When the dielectric dissipation factor, also called the dielectric loss tangent (tan. δ) of the dielectric board 17 exceeds 1% in a working frequency band, the insertion loss of a high-frequency filter increases and significantly deteriorate the performance characteristic of the high-frequency filter. For example, in the case of cordless telephone for use in a frequency band of 900 MHz, a maximum insertion loss allotted to high-frequency filters is about 5 dB. When a dielectric board 7 with tan. $\delta = 1\%$ is used, the insertion loss of the high-frequency filter is 2 dB. However, when a dielectric board 7 with tan.$\delta > 1\%$ is used, the insertion loss of the high-frequency filter exceeds 6 dB. In this condition, the high-frequency filter is no longer possible to perform the desired function.

Various characteristics of the dielectric boards produced according to the formulation shown in Table 1 are tabulated as shown in Table 2.

In Table 2, sample Nos. 2–8, 10–13, 16–22 and 25 are dielectric boards according to inventive examples, while other samples are dielectric boards according to comparative examples.

As evidenced from Table 2, the samples of the inventive examples have critical stress intensity factors not less than 5 MPa·m$^{1/2}$, excellent aging resistances, and small dielectric dissipation factors (tan. δ). The term "aging resistance" is used herein to refer to the ability to oppose or resist a drop in the toughness and mechanical strength of a dielectric board which may occur, with passage of time, after a maximum bending strength and a maximum fracture energy of the dielectric board are reached during an aging test in which the dielectric board is allowed to stand under certain temperatures. In Table 2, the aging resistance is represented by the ratio of the bending strength of a dielectric board after aging at 200°–1000° C. for 100 hours, to the initial bending strength of the dielectric board.

$Al_2O_3$ and $SiO_2$ used as additives have a function to increase the aging resistance. However, when the content of these additives exceeds 0.5 parts by weight, a sudden drop in the bending strength of the dielectric board will take place. $TiO_2$, CoO, $MnCO_3$ and NiO used as additives have a function to improve the electric property indicated by the dielectric dissipation factor tan. δ of the dielectric board. However, these additives when used in an amount exceeding 1 part by weight will deteriorate the electric property (tan. δ) of the dielectric board.

Sample Nos. 10 and 11 are formulated by using a specified amount of additive added in outer percentage to 100 parts by weight of the composite of sample No. 2. Similarly, sample Nos. 12 to 15 are formulated by using a specified amount of additive/additives added in outer percentages to 100 parts by weight of the composite of sample No. 3. Sample Nos. 16 to 24 are formulated by using a specified amount of additive/additives added to 100 parts by weight of the composite of sample 5.

As described above, a high-frequency filter of this invention comprises a plurality of resonators open at least at one end thereof, a dielectric board forming an input/output coupling and an interstage coupling, and a case for holding therein the resonators and the dielectric board. The dielectric board is made of a ceramic having a critical stress intensity factor $K_{1c}$ of not less than 5 MPa m$^{1/2}$ and a dielectric dissipation factor tan. δ of not exceeding 1% in a working frequency band of the high-frequency filter. Electrodes are formed on the dielectric board so as to form an input/output coupling capacity and an interstage coupling capacity. With this construction, the mechanical strength of the high-frequency filter is greatly increased. The dielectric board preferably made of partial stabilized zirconia or tetragonal zirconia is a ceramic having a toughening mechanism formed by the martensitic transformation and is able to overcome a problem of brittleness associated with the general calcined alumina and other dielectric ceramics.

Obviously, various minor changes and modifications of the present invention are possible in the light of the above teaching. It is therefore to be understood that within the scope of the appended claims the invention may be practiced otherwise than as specifically described.

TABLE 1

| Sample | Ingredients (Mol %) | | | | | Additive Ingredients (Part by Weight) | | | | | |
|---|---|---|---|---|---|---|---|---|---|---|---|
| No. | $ZrO_2$ | CaO | MgO | $Y_2O_3$ | $CeO_2$ | $Al_2O_3$ | $SiO_2$ | $TiO_2$ | CoO | MnO | NiO |
| 1 | 83 | 17 | | | | | | | | | |
| 2 | 85 | | 15 | | | | | | | | |
| 3 | 90 | | | 10 | | | | | | | |
| 4 | 90 | | 3 | 5 | 2 | | | | | | |
| 5 | 98 | | | 2 | | | | | | | |
| 6 | 98 | | | | 2 | | | | | | |
| 7 | 95 | | | | 5 | | | | | | |
| 8 | 98 | 1 | 0.5 | 0.5 | | | | | | | |
| 9 | 99 | | | 1 | | | | | | | |
| 10 | Sample No. 2 | | | | | 0.2 | | | | | |
| 11 | " | | | | | 0.5 | | | | | |
| 12 | Sample No. 3 | | | | | 0.1 | 0.3 | | | | |
| 13 | " | | | | | | 0.4 | | | | |
| 14 | " | | | | | 0.7 | | | | | |
| 15 | " | | | | | | 0.8 | | | | |
| 16 | Sample No. 5 | | | | | | | 0.005 | | | |
| 17 | " | | | | | | | | 0.1 | | |
| 18 | " | | | | | | | | | 0.5 | |
| 19 | " | | | | | | | | | | 1.0 |
| 20 | " | | | | | | | 1.0 | | | |
| 21 | " | | | | | | | 0.3 | 0.3 | 0.1 | 0.1 |
| 22 | Sample No. 5 | | | | | | | | 0.1 | 0.1 | 0. |
| 23 | " | | | | | | | 1.5 | | | |
| 24 | " | | | | | | | | | 0.5 | |
| 25 | 96% $Al_2O_3$ board | | | | | | | | | | |
| 26 | MgO—CaO—$TiO_2$ board | | | | | | | | | | |

TABLE 2

| Sample No. | Critical Stress Intensity Factor (MPa · m½) | Aging Resistance (%) | tan. δ (%) |
|---|---|---|---|
| 1 | 3.3 | 60 | 0.3 |
| 2 | 5.0 | 70 | 0.2 |
| 3 | 5.5 | 60 | 0.2 |
| 4 | 6.2 | 55 | 0.2 |
| 5 | 7.0 | 50 | 0.2 |
| 6 | 6.5 | 55 | 0.2 |
| 7 | 5.5 | 50 | 0.2 |
| 8 | 6.8 | 40 | 0.2 |
| 9 | 4.1 | 50 | 0.2 |
| 10 | 5.0 | 75 | 0.3 |
| 11 | 5.0 | 70 | 0.3 |
| 12 | 5.7 | 70 | 0.2 |
| 13 | 5.7 | 75 | 0.2 |
| 14 | 4.5 | 10 | 0.2 |
| 15 | 4.4 | 5 | 0.2 |
| 16 | 7.0 | 50 | 0.2 |
| 17 | 7.3 | 55 | 0.1 |
| 18 | 6.9 | 60 | 0.1 |
| 19 | 6.5 | 40 | 0.1 |
| 20 | 6.5 | 40 | 0.1 |
| 21 | 7.1 | 45 | 0.1 |
| 22 | 7.2 | 30 | 0.1 |
| 23 | 4.3 | 3 | 0.8 |
| 24 | 4.5 | 1 | 1.3 |
| 25* | 5.5 | 95 | 0.1 |
| 26 | 3.0 | 100 | 0.2 |

Note: Sample No. 25 is HIP product.

What is claimed is:

1. A high-frequency filter which comprises a plurality of resonators open at least at one end thereof, a plurality of input/output terminals, and a dielectric board supporting thereon said resonators and said input/output terminals and forming an input/output coupling and an interstage coupling, wherein said dielectric board is made of a ceramic having a critical stress intensity factor $K_{1c}$ of not less than 5 MPa·m½ and a dielectric dissipation factor tan. δ of not exceeding 1% in a working frequency band of said high-frequency filter.

2. A high-frequency filter according to claim 1, wherein said ceramic contains, as the principal ingredient, partial stabilized zirconia.

3. A high-frequency filter according to claim 1, wherein said ceramic contains, as the principal ingredient, tetragonal zirconia.

4. A high-frequency filter according to claim 1, wherein said ceramic comprises 85 to 98 mol percent of $ZrO_2$, and 15 to 2 mol percent of at least one component selected from the group consisting of $CeO_2$, CaO, MgO and $Y_2O_3$.

5. A high-frequency filter according to claim 1, wherein said ceramic includes up to 0.5 part by weight, per 100 parts by weight of partial stabilized zirconia, of at least one component selected from the group consisting of $Al_2O_3$ and $SiO_2$.

6. A high-frequency filter according to claim 1, wherein said ceramic includes up to 0.5 part by weight, per 100 parts by weight of tetragonal zirconia, of at least one component selected from the group consisting of $Al_2O_3$ and $SiO_2$.

7. A high-frequency filter according to claim 1, wherein said ceramic includes up to 1 part by weight, per 100 parts by weight of partial stabilized zirconia, of at least one component selected from the group consisting of $TiO_2$, CoO, MnO and NiO.

8. A high-frequency filter according to claim 1, wherein said ceramic includes up to 1 part by weight, per 100 parts by weight of tetragonal zirconia, of at least one component selected from the group consisting of $TiO_2$, CoO, MnO and NiO.

9. A high-frequency filter which comprises a dielectric board, a plurality of electrodes formed on said dielectric board, a plurality of resonators of the coaxial type connected respectively to said electrodes, a plurality of input/output terminals attached to said dielectric board, and a case attached to said dielectric board for closing said resonators, wherein said dielectric board is made of a ceramic having a critical stress intensity factor $K_{1c}$ of not less than 5 MPa·m½ and a dielectric dissipation factor tan δ of not exceeding 1% in a working frequency band of said high-frequency filter.

10. A high-frequency filter according to claim 9, wherein said ceramic contains, as the principal ingredient, partial stabilized zirconia.

11. A high-frequency filter according to claim 9, wherein said ceramic contains, as the principal ingredient, tetragonal zirconia.

12. A high-frequency filter according to claim 9, wherein said ceramic comprises 85 to 98 mol percent of $ZrO_2$, and 15 to 2 mol percent of at least one component selected from the group consisting of $CeO_2$, CaO, MgO and $Y_2O_3$.

13. A high-frequency filter according to claim 9, wherein said ceramic includes up to 0.5 part by weight, per 100 parts by weight of partial stabilized zirconia, of at least one component selected from the group consisting of $Al_2O_3$ and $SiO_2$.

14. A high-frequency filter according to claim 9, wherein said ceramic includes up to 0.5 part by weight, per 100 parts by weight of tetragonal zirconia, of at least one component selected from the group consisting of $Al_2O_3$ and $SiO_2$.

15. A high-frequency filter according to claim 9, wherein said ceramic includes up to 1 part by weight, per 100 parts by weight of partial stabilized zirconia, of at least one component selected from the group consisting of $TiO_2$, CoO, MnO and NiO.

16. A high-frequency filter according to claim 9, wherein said ceramic includes up to 1 part by weight, per 100 parts by weight of tetragonal zirconia, of at least one component selected from the group consisting of $TiO_2$, CoO, MnO and NiO.

17. A high-frequency filter according to claim 9, wherein said electrodes are made of Ag.

18. A high-frequency filter in combination with movable radio communication equipment comprising:

a plurality of resonators open at least at one end thereof, a plurality of input/output terminals, and a dielectric board supporting thereon said resonators and said input/output terminals and forming an input/output coupling and an interstage coupling, wherein said dielectric board is made of a ceramic having a critical stress intensity factor $K_{1c}$ of not less than 5 MPa·m½ and a dielectric dissipation factor tan. δ of not exceeding 1% in a working frequency band of said high-frequency filter. a dielectric dissipation factor tan. δ of not exceeding 1% in a working frequency band of said high-frequency filter.

19. A high-frequency filter in combination with movable radio communication equipment comprising:

a dielectric board, a plurality of electrodes formed on said dielectric board, a plurality of resonators of the coaxial type connected respectively to said electrodes, a plurality of input/output terminals attached to said dielectric board, and a case attached to said dielectric board for closing said resonators, wherein said dielectric board is made of a ceramic having a critical stress intensity factor $K_{1c}$ of not less than 5 Mpa·m½ and a dielectric dissipation factor tan. δ of not exceeding 1% in a working frequency band of said high-frequency filter.

20. A high-frequency filter in combination with movable radio communication equipment according to claim 19, wherein said ceramic comprises 85 to 98 mol percent of $ZrO_2$, and 15 to 2 mol percent of at least one component selected from the group consisting of $CeO_2$, CaO, MgO and $Y_2O_3$.

* * * * *